US012564782B1

(12) United States Patent
Drake, Jr.

(10) Patent No.: US 12,564,782 B1
(45) Date of Patent: Mar. 3, 2026

(54) PINBALL MACHINE RAMP

(71) Applicant: Stern Pinball, Inc., Elk Grove Village, IL (US)

(72) Inventor: J. Harrison Drake, Jr., Mount Prospect, IL (US)

(73) Assignee: Stern Pinball, Inc., Elk Grove Village, IL (US)

( * ) Notice: Subject to any disclaimer, the term of this patent is extended or adjusted under 35 U.S.C. 154(b) by 769 days.

(21) Appl. No.: 17/860,619

(22) Filed: Jul. 8, 2022

Related U.S. Application Data

(60) Provisional application No. 63/219,466, filed on Jul. 8, 2021.

(51) Int. Cl.
*A63F 7/02* (2006.01)
*A63F 7/36* (2006.01)

(52) U.S. Cl.
CPC ..... *A63F 7/027* (2013.01); *A63F 2007/3648* (2013.01)

(58) Field of Classification Search
CPC .. A63F 7/025; A63F 7/027; A63F 7/28; A63F 7/30; A63F 2007/3648
See application file for complete search history.

(56) References Cited

U.S. PATENT DOCUMENTS 2,226,885 A 12/1940 Williams et al.
2,791,428 A 5/1957 Mcdonald
4,861,037 A * 8/1989 Oursler ..... A63F 7/027 273/121 D
5,120,058 A * 6/1992 Trudeau ..... A63F 7/027 273/127 R
5,297,793 A * 3/1994 DeMar ..... A63F 7/027 273/121 A
5,417,423 A * 5/1995 Oursler ..... A63F 7/027 273/127 R
5,558,327 A * 9/1996 Hansen ..... A63F 7/027 273/127 R
5,664,777 A * 9/1997 Nordman ..... A63F 7/027 273/127 R
5,899,454 A * 5/1999 Eddy ..... A63F 7/3075 273/127 R
5,938,195 A * 8/1999 Anghelo ..... A63F 7/027 273/127 R
5,944,309 A * 8/1999 Popadiuk ..... A63F 7/027 273/121 A

* cited by examiner

*Primary Examiner* — Raleigh W Chiu
(74) *Attorney, Agent, or Firm* — Greenberg Traurig, LLP

(57) ABSTRACT

A pinball machine includes an inclined playfield having a pair of lower flippers located near a lower portion of the inclined playfield and at least one upper flipper. A ramp is mounted to the inclined playfield and arranged so that the ball propelled from each of the flippers may enter the ramp and travel the length of the ramp. The ramp includes a ramp surface having a ramp entrance configured to be disposed on the playfield, a ramp main portion, and a ramp exit. a pair of sidewalls is disposed adjacent opposite sides of the ramp surface and the ramp surface has a first width at the ramp entrance, a second width at the ramp exit, and a third width intermediate the ramp entrance and the ramp exit, the third width being greater than the first width and the second width.

16 Claims, 4 Drawing Sheets

PINBALL MACHINE RAMP

CROSS REFERENCE TO RELATED APPLICATION

This application is a non-provisional application claiming priority from U.S. Provisional Application Ser. No. 63/219,466, filed Jul. 8, 2021, and incorporated herein by reference in its entirety.

FIELD OF THE DISCLOSURE

The present disclosure relates generally to amusement games and more particularly to a pinball machine having a ramp with an enhanced entrance profile.

BACKGROUND

Amusement game devices, such as pinball machines, redemption games, etc. of the commercial, e.g., revenue generating, and non-commercial, e.g., home entertainment, type are generally well known in the art. By way of example, U.S. Pat. Nos. 2,226,885 and 2,791,428 each illustrate and describe amusement game devices, such as pinball games, of the type having a cabinet which houses a confined ball on a playfield, each of which are incorporated herein by reference in their entirety.

In a typical pinball game, a ball is propelled into play on an inclined playfield with a ball plunger assembly and during gameplay, the pinball strikes various elements and gaming assemblies with each strike registering a score and/or a gaming event. The various game elements may include ramps, ball guides, formed lanes, drop targets, pop bumpers, spinners, bash toys, etc. At least two flipper assemblies are usually provided at the lower end of the playfield to propel the ball back into play on the playfield and to impact additional game elements.

One such gaming element is a ramp, which typically is arranged to guide a ball off of the playfield and towards various additional gaming elements and/or features. For instance, U.S. Pat. No. 5,944,309 describes an illuminable ramp assembly for a pinball game comprising an elongated molded plastic housing and a ball ramp extending alongside the housing. The ball ramp includes an entry end and an exit end.

U.S. Pat. No. 5,899,454, meanwhile, describes a ramp with an integral ball deflector. The ramp includes an entrance level with the playfield, and a ball deflector having the shape of a triangle mounted upon the bottom of the ramp with its widest portion near to the ramp entrance. When a ball rolls down the ramp, such as during roll back, it is directed away from one of the sidewalls of the ramp by the ball deflection surface so that it later avoids an undesirable location on the playfield. A bifurcated entrance plate is connected between the ramp entrance and the playfield so that the ball deflector has a minimal effect upon a ball entering the ramp.

While the various elements and gaming assemblies, such as the ramps described above, may generally work for their intended purposes, there is an identifiable need for various enhancements and improvements to amusement game features including ramps with enhanced entrance profiles as disclosed below.

BRIEF DESCRIPTION OF THE DRAWINGS

For a better understanding of the rotatable ball momentum transfer assembly disclosed hereinafter reference may be had to the following drawings.

DETAILED DESCRIPTION

The following description of example methods and/or apparatus is not intended to limit the scope of the description to the precise form or forms detailed herein. Instead the following detailed description is intended to be illustrative so that others may follow the example teachings.

With reference to the figures, an amusement game device, in the example form of a pinball machine 10 is now described. It is to be appreciated, however, that this example form for the amusement game device is not intended to be limiting. Rather, those of ordinary skill in the art will appreciated that the example ramp assembly disclosed hereinafter can be utilized in any type of amusement game device of the commercial and non-commercial type in which it is desired to create a ramp as disclosed.

Figure 1:
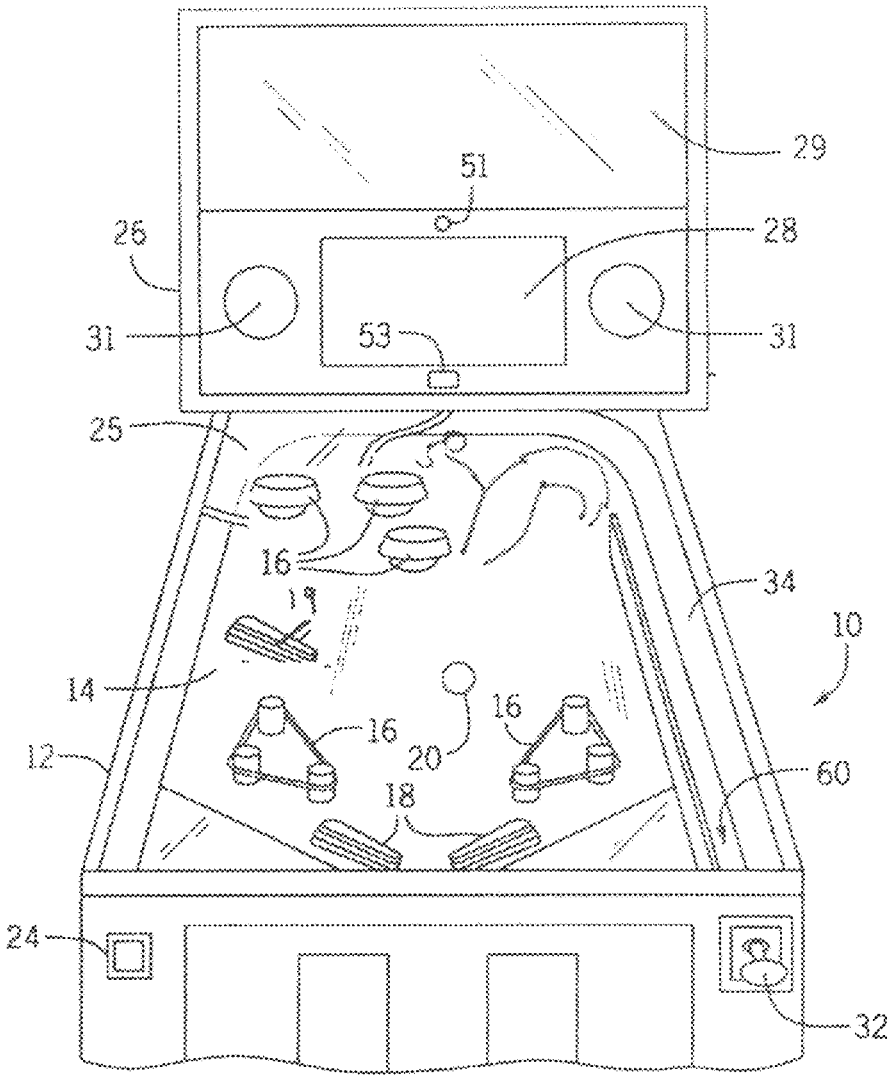
FIG. 1 illustrates an example amusement game device in the form of a pinball machine including an example of the disclosed enhanced ramp.

The example pinball machine 10 illustrated in FIG. 1 includes a cabinet 12 which houses various apparatus used to define play of a game (e.g., "gameplay"). Gameplay may be commenced in response to insertion of money, paper or coins referred to collectively as "coins", into a coin accepting device, upon exercising of credits earned, by accepting payment from an account, e.g., via use of a swipe card reading device, a bar code reading device, a near field communications device, etc., and/or by otherwise making game play active, including free play. Upon activation of the game in this manner, gameplay, in the case of the example pinball machine 10, is defined upon an inclined playfield 14 that supports a number of playfield elements, accessories, and/or devices.

More particularly, in the case of the example pinball machine 10, gameplay is generally defined through the use of a pair of pivotable, lower flippers 18 to propel a ball 20 for movement relative to an upperside (e.g., a top surface) of the playfield 14 and input devices/accessories associated with the playfield 14. In this example the playfield 14 also includes at least one pivotable, upper flipper 19 that is located near an upper portion of the playfield 14 away (e.g. distally located) from the player and the lower flippers 18. In this example, the upper flipper 19 may be utilized by a player to further propel the ball 20 along the playfield 14 and/or change the trajectory of the ball 20 when actuated by the player or when the ball 20 otherwise hits and/or deflects off of the upper flipper 19. The playfield 14 is usually inclined from the horizontal, such as for instance between approximately 6.5 to 7.0 degrees, such that the ball tends to eventually roll back down the playfield 14 in the direction of the lower flippers 18. While not intended to be limiting, the playfield accessories or input devices may include elements such as bumpers 16, targets (e.g. drop bank targets, spinner targets, etc.; not shown), and/or at least one ramp 50 which will be described in greater detail hereinafter.

The playfield 14 may be covered by a transparent or glass sheet cover 25 to permit viewing of the playfield 14. In addition to the foregoing, the playfield 14 typically includes a plunger element 32 which shoots or launches the ball 20 up an alley 34 onto the playfield 14. The playfield 14 may also include lighting elements—which may also be included as a part of the any of the input devices/accessories—and/or other features as desired. Other player-activated input elements, typically in the form of push-buttons (not shown) on the sides (or other location) of the cabinet 12, are usually provided for controlling operation of the lower flippers 18, the upper flipper 19, or otherwise interacting with gameplay. The pinball machine 10 may also include a backbox 26 which is mounted to overlay a top rear portion of the cabinet 12 and which in this example contains artwork 29, and a display 28, such as a dot matrix display, CRT, LED or plasma display, or the like. The backbox 26 may also support speakers 31 associated with the game sound system. Within the backbox 26 may be located various ones of the electronic devices/circuits for controlling the operation of the playfield 14, the display 28, general illumination, and the sound system, including the speakers 31 and any additional sound system components. For example, the backbox 26 may optionally comprise a camera 51 and/or a microphone 53, which may be mounted to any suitable portion of the gaming machine 10, and may be separately or integrally mounted as desired, to allow for video and/or sound functionality. Such electronic devices/circuits could also, in whole or in part, be carried within the cabinet 12, or may be external to the game cabinet and linked to the pinball machine 10 via any suitable wired or wireless configuration.

Figure 2:
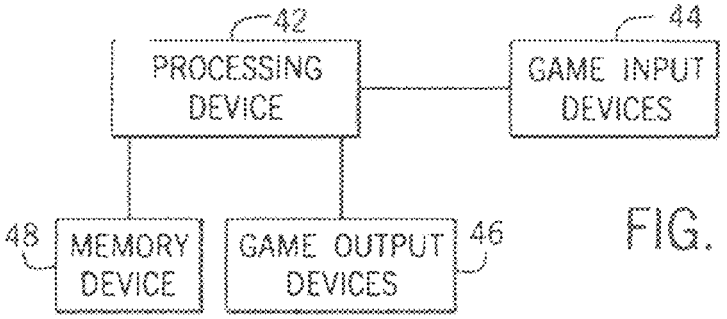
FIG. 2 is an example block diagram of example components of the amusement game device of FIG. 1.
Figure 3:
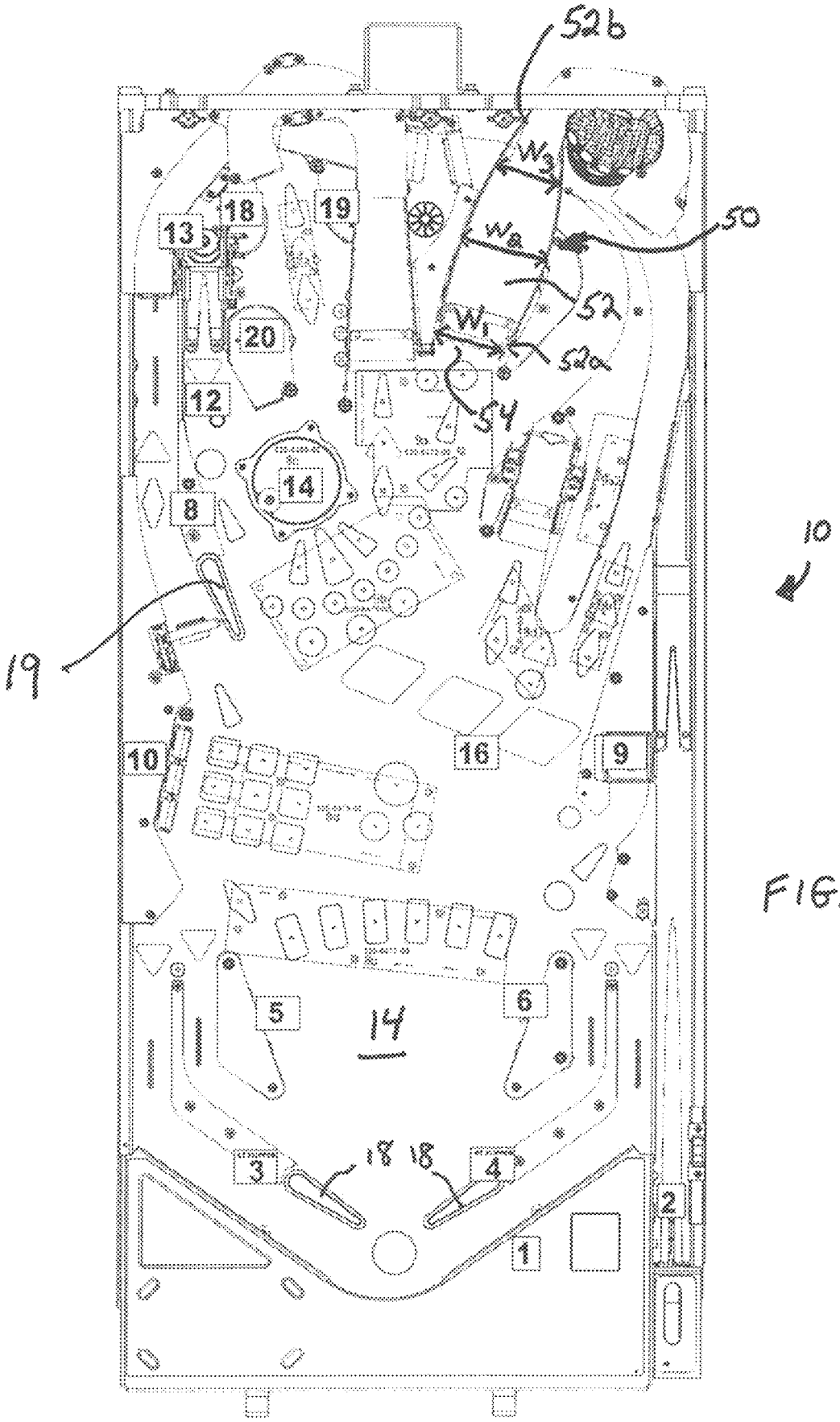
FIG. 3 is a top plan view of an example playfield of the pinball machine of FIG. 1 including the example enhanced ramp.
Figure 4:
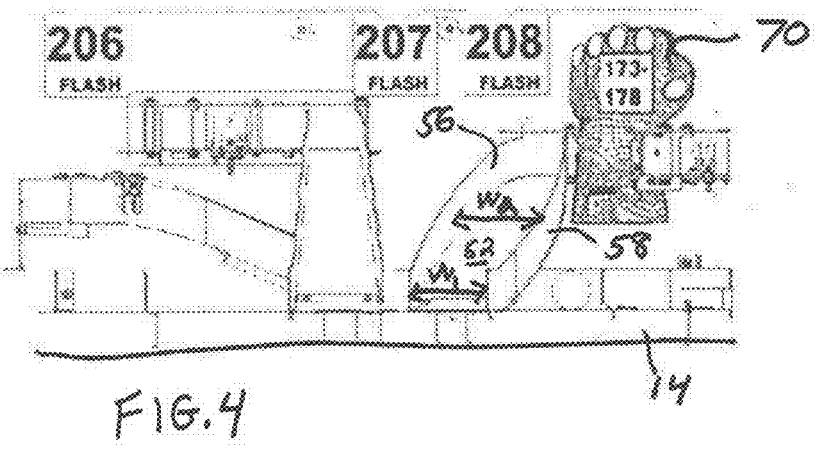
FIG. 4 is a front cross-sectional view of the example playfield of FIG. 3 taken along line 4-4.

Referring to FIG. 2, for controlling the various devices that form the amusement game, the example pinball machine 10 is provided with a processing device 42 which processing device 42 is, in turn, coupled to game input devices 44, such as switches associated with the cabinet 12 or the playfield 14, and game output devices 46, such as lights (including lights associated with the playfield), the bumpers 16, the lower flippers 18, the upper flipper 19, the display 28, etc. via one or more bus systems. A memory device 48, such as a RAM, ROM, or the like, stores instructions and data usable by the processing device 42 to control gameplay, the game output devices 46, and the game input devices 44 as necessary based upon signals provided by the game input devices 44. It is to be understood that this illustrated example is not intended to be limiting and that other manners for arranging the devices illustrated in FIG. 2 to provide for control of play of the amusement game can be utilized as needed.

Turning now to FIGS. 3-6, disposed upon the playfield 14 is one or more gameplay accessories, targets, spinners, etc., including the example ramp 50. The ramp 50 comprises a ramp base 52 that meets the playfield 14 along a lower edge 54 of the ramp base 52. In this example, the ramp base 52 is a plate. A lower end 52*a* of the ramp base 52 is positioned on the playfield 14 while an upper end 52*b* of the ramp base 52 is, in this example, elevated above the playfield 14. In this example, at least a portion of ramp 50 is inclined when moving from the lower end 52*a* towards the upper end 52*b*. It will be understood that while the lower edge 54 is disclosed as being "on" the playfield 14, the lower edge 54 need not actually touch the playfield 14, but rather may be sufficiently close to the playfield 14 to allow the ball 20 to roll from the playfield 14 onto the ramp 50 with sufficient velocity. Moreover, it will be appreciated that the shape of the ramp 50 may be such that the upper end 52*b* is elevated above or adjacent the playfield 14 (i.e., the ramp may return the ball 20 to the playfield 14).

As illustrated, the example ramp 50 comprises a first sidewall 56 and an opposing, second sidewall 58 coupled to the ramp base 52. At the lower end 52*a*, the ramp base 52, the first sidewall 56, and the second sidewall 58 together define a ramp entrance 60. Meanwhile, at the upper end 52*b*, the ramp base 52, the first sidewall 56, and the second sidewall 58 together define a ramp exit 61. In most instances, the ramp entrance 60 is configured to be slightly larger than the diameter of the ball 20 in order to limit the angle θ through which the ball 20 may enter the ramp 50, thereby requiring player skill. Additional features may define and/or be located at the ramp entrance 60 including, for example, gates, spinners, posts, targets, rubbers, lights, etc.

Figure 5:
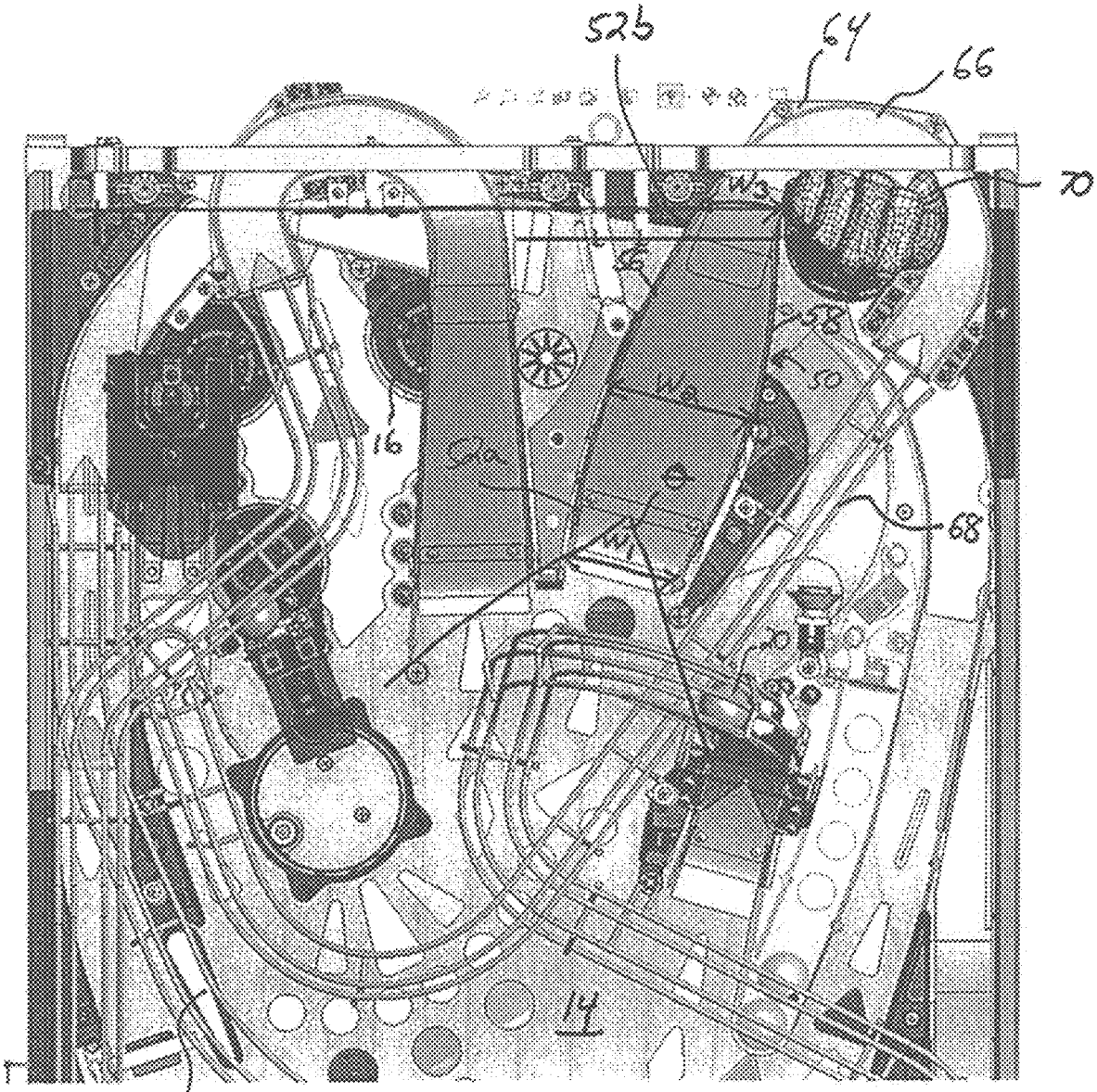
FIG. 5 is an enlarged detail view of the example playfield of FIG. 3 including example additional game features.

Further, as is known in the art, the ramp exit 61 may lead to additional play features such as ball passages, targets, ramps (such as illustrated in FIG. 5), or other suitable feature. As such, in order for the ball 20 to access these features, the player must contact the ball 20 with either of the lower flippers 18 or the upper flipper 19 so that the ball 20 has the direction and velocity necessary to successfully enter the ramp entrance 60 and thereby negotiate the ramp 50.

In many instances, however, because of the size of the ramp entrance 60, the orientation of the ramp entrance 60, and/or the location of the ramp 50 on the playfield 14, among other things, the ramp entrance 60 and therefore the ramp 50 may not be accessible by the ball 20 propelled and/or deflected from each of the lower flippers 18 and the upper flipper 19. This may be because the trajectory of the ball 20 propelled by the lower flippers 18 and the upper flipper 19 through the ramp entrance 60 may be such that the ball 20 ricochets off either of the first sidewall 56 or the second sidewall 58 thus losing velocity and/or energy. In such instances, the ball 20 typically will climb only part way up the incline of the ramp 50, stop and then "roll back" towards the player without having fully traversed the ramp 50 and accessing the upper end 52*b* or any of the additional play features (if any).

To reduce the likelihood of the ball 20 ricocheting off one or both of the first sidewall 56 or the second sidewall 58 while still providing the ramp entrance 60 with a sufficiently non-enlarged width to require a skill shot, the ramp 50 has an enhance profile. In this example, the ramp base 52 of the ramp 50 has a longitudinal perimeter 62 including opposite sides of the ramp surface, namely a first perimeter 62*a* and a second perimeter 62*b* that that are both generally arcuate along their length moving from the lower end 52*a* of the ramp 50 towards the upper end 52*b* of the ramp 50. Together, the ramp base 52, the first sidewall 56, and the second sidewall 58 define a ball path between the ramp entrance 60 and the ramp exit 61. The ramp entrance 60, therefore, has a first width W1 at the ramp entrance 60, a second width W2 along the ball path intermediate the ramp entrance 60 and the ramp exit 61, and a third width W3 at the ramp exit 61. The first width W1 at the ramp entrance 60 and the third width W3 at the ramp exit 61 are smaller than the second width W2 intermediate the ramp entrance 60 and ramp exit 61. Further, in the illustrated example the third width W3 is substantially the same as the first width W1. Thus, the ramp 50 generally has a double-convex shape when viewed from above the ramp 50.

As further illustrated, each of the first sidewall 56 and the second sidewall 58, extend upwards from the first perimeter 62*a* and the second perimeter 62*b*, respectively. In this example, the first sidewall 56 and the second sidewall 58 extend perpendicular from the first sidewall 56 and the second sidewall 58, although the sidewall may be otherwise coupled to the ramp base 52. Each of the first sidewall 56 and the second sidewall 58 are also correspondingly arcuate and bow outwards from the ramp entrance 60 and then back inwards from the lower end 52*a* of the ramp 50 towards the upper end 52*b*. In this example, the sidewalls bow out with approximately a 12" (twelve inch) radius of curvature to an 18" (eighteen inch) radius of curvature. More specifically, in this illustrated example the first sidewall 56 has approximately a 12" radius of curvature, while the second sidewall 58 has approximately an 18" radius of curvature. It will be appreciated by one of ordinary skill in the art that the radius of the sidewalls may be varied and furthermore, the first sidewall 56 and/or the second sidewall 58 may be contiguously formed or may be broken into various components as desired.

Figure 6:
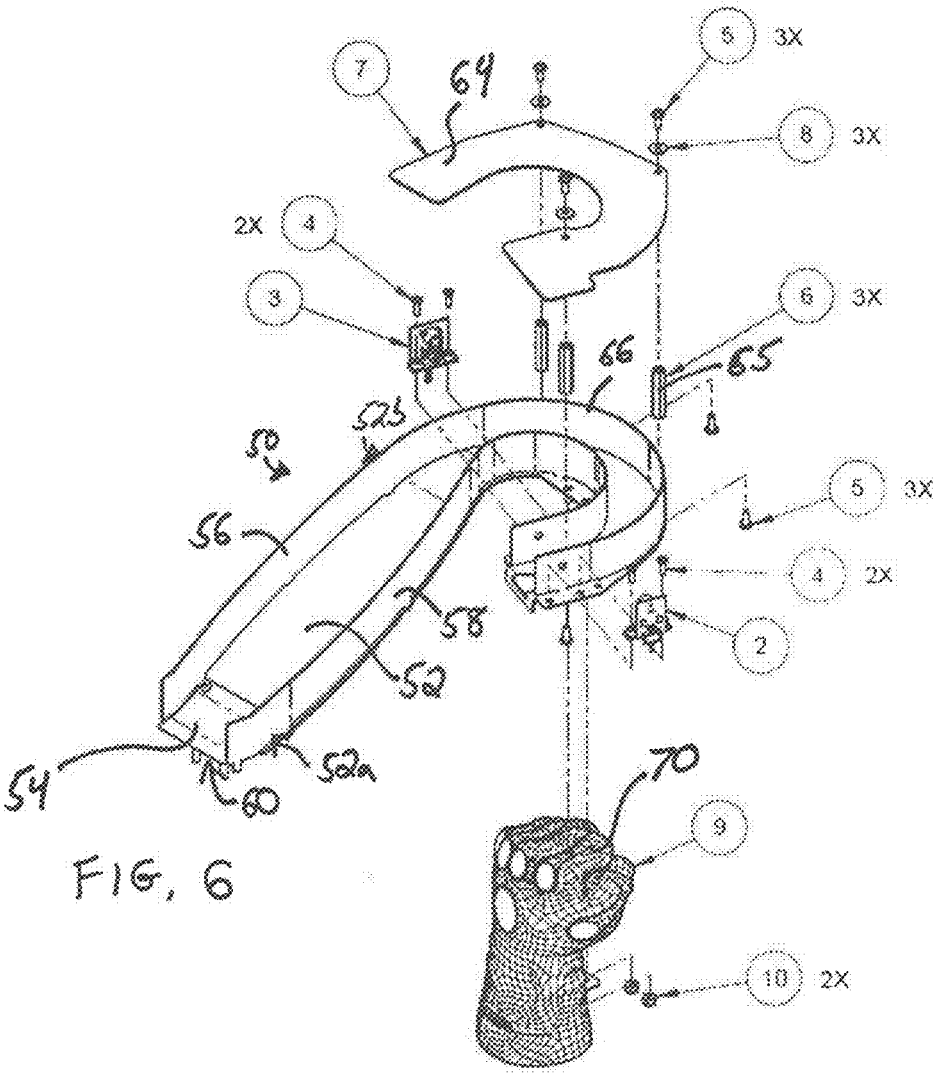
FIG. 6 is an exploded perspective view of the example enhanced ramp of the present disclosure.

In the example best illustrated in FIG. 6, the ramp 50 optionally includes a ramp cover 64 fastened to the ramp 50 via fasteners 65 to assist in the prevention of the ball 20 leaving the ramp 50 when the ball 20 is traveling up the ramp 50 with significant speed. Also as illustrated in the figures, the example ramp 50 may include any additional feature, ramp extension, etc. at the upper end 52*b*, including in this instance a U-shaped ramp 66 having a wire ramp 68 portion (see FIG. 5) and various features such as a toy 70.

As previously noted, the structure of the example ramp 50 allows for a variety of "shots" to successfully negotiate travel through the ramp entrance 60 and yet still traverse the entire length of the ramp 50 without significant ricochet or otherwise losing energy such as to not be able to traverse the length of the ramp 50. By constructing the ramp 50 with an increasing width as disclosed, the entrance angle θ is increased from that of a typical straight ramp profile or funnel shaped profile with the same sized ramp entrance. For instance, in the example configuration of the playfield 14, the ramp 50 is accessible from both the lower flippers 18 and the upper flipper 19.

The particular arrangements disclosed herein are meant to be illustrative only and not limiting as to the scope of the invention which is to be given the full breadth of the appended claims and any equivalents thereof.

I claim:

1. A ramp for a pinball machine, the pinball machine having an inclined playfield for supporting movement of a ball thereon, comprising:

a ramp surface having a lower end configured to be disposed on the inclined playfield and an upper end, so that the ball may enter the ramp at the lower end, travel on the ramp surface, and exit at the upper end;

a pair of sidewalls disposed adjacent opposite perimeter sides of the ramp surface extending between the lower end and the upper end, the pair of sidewalls and the ramp surface together defining a ball path therebetween with a ramp entrance at the lower end and a ramp exit at the upper end; and a ramp extension coupled to the ramp exit so that the ball may exit at the ramp exit and interact with the ramp extension, wherein the ramp entrance has a first width, the ramp exit has a second width and the ball path between the ramp entrance and the ramp exit has third width intermediate the ramp entrance and the ramp exit, the third width being greater than the first width and the second width.

2. The ramp of claim 1, wherein the ramp surface is a plate.

3. The ramp of claim 1, wherein the pair of sidewalls are plates.

4. The ramp of claim 3, wherein the pair of sidewalls extend perpendicular from the ramp surface.

5. The ramp of claim 1, wherein the ramp exit is configured to be disposed elevated above the inclined playfield.

6. The ramp of claim 1, wherein the first width is the same as the second width.

7. The ramp of claim 1, wherein each of the sidewalls is arcuate.

8. The ramp of claim 7, wherein each of the sidewalls has a radius of curvature of between 12 inch and 18 inch.

9. The ramp of claim 8, wherein the radius of curvature of a first sidewall of the pair of sidewalls is 12 inch and the radius of curvature of a second sidewall of the pair of sidewalls is 18 inch.

10. The ramp of claim 1, wherein the lower end of the ramp surface comprises a lower edge disposed on the inclined playfield.

11. A pinball machine comprising:

an inclined playfield for supporting movement of a ball thereon;

a pair of lower flippers located proximate a lower portion of the inclined playfield, the pair of lower flippers each configured to propel the ball towards an upper portion of the inclined playfield;

an upper flipper distally located from the pair of lower flipper towards the upper portion of the inclined playfield, the upper flipper configured to propel the ball along the inclined playfield; and a ramp mounted to the inclined playfield and arranged so that the ball may enter the ramp when propelled by each of the upper flipper and the pair of lower flippers, the ramp comprising:

a ramp surface having a ramp entrance configured to be disposed on the inclined playfield, a ramp main portion, and a ramp exit, the ball entering the ramp at the ramp entrance, travel on the ramp main portion, and exit at the ramp exit; and a pair of sidewalls disposed adjacent opposite sides of the ramp surface, each of the sidewalls is arcuate having a radius of curvature extending an entire length of the ramp surface, wherein the ramp surface has a first width at the ramp entrance, a second width at the ramp exit, and a third width intermediate the ramp entrance and the ramp exit, the third width being greater than the first width and the second width for the entire length of the ramp surface between the ramp entrance and the ramp exit.

12. The pinball machine of claim 11, wherein each of the ramp surface and the pair of sidewalls are plates.

13. The pinball machine of claim 11, wherein the ramp exit is disposed elevated above the inclined playfield.

14. The pinball machine of claim 11, wherein the first width is the same as the second width.

15. The pinball machine of claim 11, wherein the radius of curvature of each of the sidewalls is between 12 inch and 18 inch.

16. The pinball machine of claim 11, wherein the radius of curvature of each of the sidewalls is a single value along the entire length of each of the sidewalls.

* * * * *